US010130192B2

(12) United States Patent
Goh et al.

(10) Patent No.: US 10,130,192 B2
(45) Date of Patent: Nov. 20, 2018

(54) DISPLAY CASE

(71) Applicant: Comicave Studios Pte Ltd, Singapore (SG)

(72) Inventors: Zheng Ning Goh, Singapore (SG); Ka-Wei Wong, Singapore (SG); Siti Rasyiqah Binte Mohamad, Singapore (SG)

(73) Assignee: Comicave Studios Pte Ltd, Singapore (SG)

( * ) Notice: Subject to any disclaimer, the term of this patent is extended or adjusted under 35 U.S.C. 154(b) by 261 days.

(21) Appl. No.: 15/251,971

(22) Filed: Aug. 30, 2016

(65) Prior Publication Data

US 2018/0055249 A1 Mar. 1, 2018

(51) Int. Cl.

| | |
|---|---|
| ***B65D 25/54*** | (2006.01) |
| ***A47F 3/00*** | (2006.01) |
| ***A47F 3/14*** | (2006.01) |
| *B65D 25/10* | (2006.01) |
| *A47F 7/00* | (2006.01) |

(52) U.S. Cl.

CPC ..... *A47F 3/005* (2013.01); *A47F 3/145* (2013.01); *A47F 2007/0092* (2013.01); *B65D 25/10* (2013.01); *B65D 25/54* (2013.01)

(58) Field of Classification Search

CPC .. A47F 3/005; A47F 3/145; A47F 2007/0092; B65D 25/10; B65D 25/20; B65D 25/54; B65D 43/0214

USPC ... 206/486, 45.2, 45.28, 751, 752, 764, 765, 206/775, 776, 781

See application file for complete search history.

(56) References Cited

U.S. PATENT DOCUMENTS

| | | | | | |
|---|---|---|---|---|---|
| 2,498,757 | A * | 2/1950 | High | B65D 5/5038 | 206/776 |
| 2,987,843 | A * | 6/1961 | Anthony | A47F 7/08 | 206/776 |
| 3,533,503 | A * | 10/1970 | Keats | B65D 75/322 | 206/776 |
| 3,935,944 | A * | 2/1976 | Wilson | A61B 50/00 | 206/569 |
| 4,552,264 | A * | 11/1985 | Quarrell | A47F 7/03 | 206/458 |
| 5,082,110 | A * | 1/1992 | Hager | A63B 47/00 | 206/232 |
| 5,358,101 | A * | 10/1994 | Lombardi | B65D 25/101 | 206/485 |
| 5,791,075 | A * | 8/1998 | Martell | A47F 3/001 | 206/315.9 |

(Continued)

*Primary Examiner* — Luan K Bui

(74) *Attorney, Agent, or Firm* — Polsinelli LLP

(57) ABSTRACT

Display case is provided that includes an upper portion and a lower portion. The upper portion has a rim defining an opening, a substantially cylindrical portion extending from the rim, and a curvilinear portion extending from the substantially cylindrical portion and terminating in a substantially flat portion. The lower portion includes a first surface having a first receiving portion formed therein, a sealing surface extending from the first surface and configured to be inserted into of the opening and engage with the substantially cylindrical portion, and a second surface opposite the first surface which forms a second receiving portion. The first receiving portion and the second receiving portion are substantially the same size and configured to receive a base of a toy.

19 Claims, 13 Drawing Sheets

(56) References Cited

U.S. PATENT DOCUMENTS

| | | | | |
|---|---|---|---|---|
| 6,047,833 | A * | 4/2000 | Salomon | B65D 25/10 206/315.1 |
| 6,209,720 | B1 * | 4/2001 | Chen | B65D 25/10 206/315.1 |

* cited by examiner

DISPLAY CASE

FIELD

The present disclosure generally relates to a display case. More particularly, the disclosure relates to display case with an upper portion and a lower portion that includes two receiving portions on opposite sides of the lower portion configured to receive a base of a toy.

BACKGROUND

Display cases have long been used to store and present items within. Display cases can have a portion that is transparent, so the item or items can be seen, or other display cases can be opaque on the exterior.

BRIEF DESCRIPTION OF THE DRAWINGS

So that the manner in which the above recited features of the present disclosure can be understood in detail, a more particular description of the disclosure, may be had by reference to examples, some of which are illustrated in the appended drawings. It is to be noted, however, that the appended drawings illustrate only typical examples of this disclosure, and are therefore not to be considered limiting of its scope, for the disclosure may admit to other equally effective examples.

DETAILED DESCRIPTION

Figure 1:
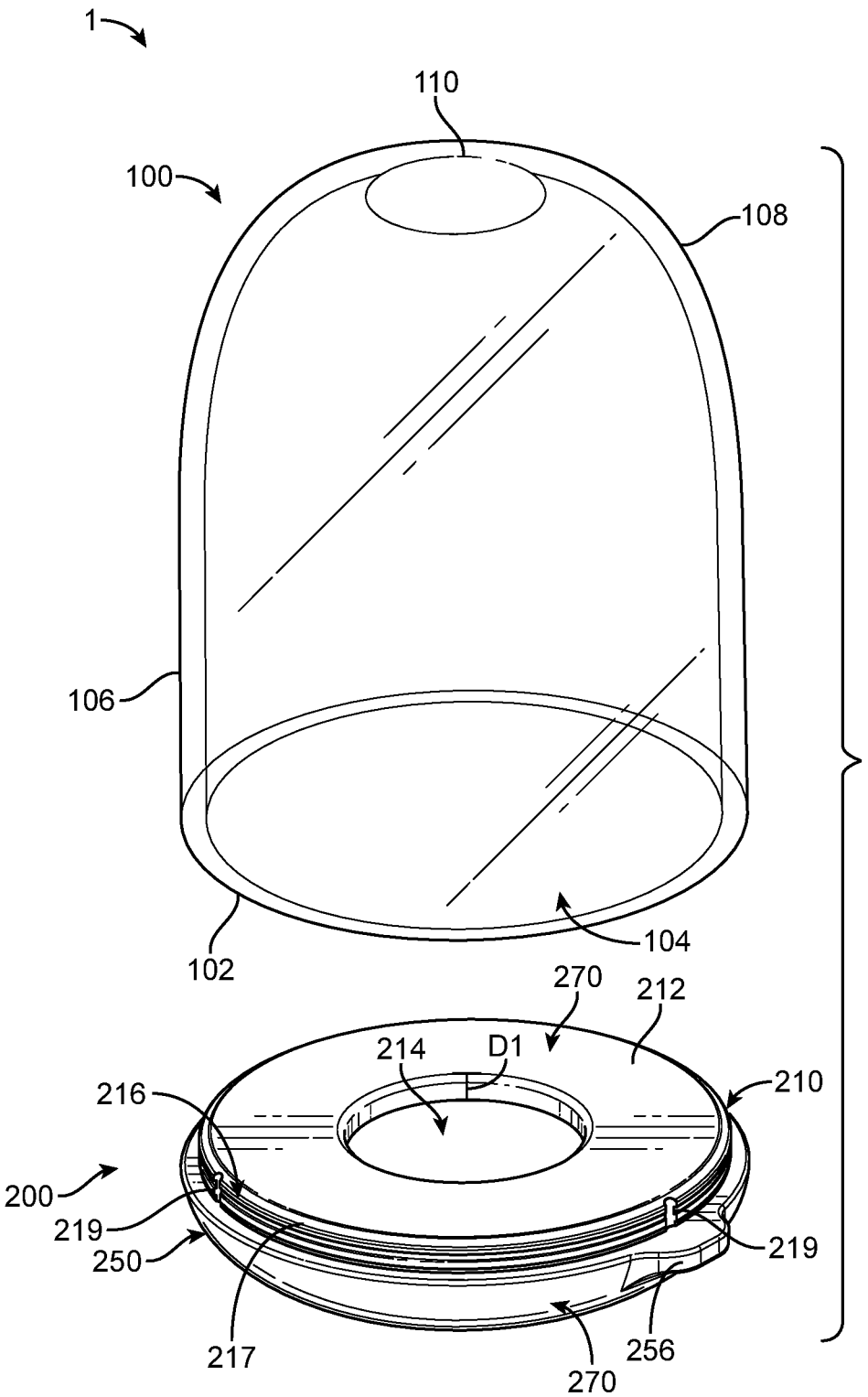
FIG. 1 is an exploded, perspective view of a display case with an upper portion and a lower portion according to an example of the present disclosure.

Various examples of the disclosure are discussed in detail below. While specific implementations are discussed, it should be understood that this is done for illustration purposes only. A person skilled in the relevant art will understand that other components and configurations can be used without parting from the spirit and scope of the disclosure.

Although illustrative implementations of one or more examples are illustrated below, the disclosed device can be implemented using any number of techniques. The disclosure should in no way be limited to the illustrative examples, drawings, and techniques illustrated herein, but can be modified within the scope of the appended claims along with their full scope of equivalents.

Unless otherwise specified, any use of any form of the terms "connect," "engage," "couple," "attach," or any other term describing an interaction between elements is not meant to limit the interaction to direct interaction between the elements and can also include indirect interaction between the elements described. In the following discussion and in the claims, the terms "including" and "comprising" are used in an open-ended fashion, and thus should be interpreted to mean "including, but not limited to." The term "transparent" means able to be seen through or not opaque. The term "substantially" means being largely but not necessarily wholly, for example, substantially transparent means that the material can be seen through but does not necessarily have to be clear. Additionally, substantially is an inclusive term that covers something that is true to form. For example, substantially cylindrical includes both cylindrical items and those items that are nearly or largely cylindrical. The term "inside" refers to a portion of an object that is within the confines of the object itself. The term "outside" refers to a portion of an object that is configured to be exposed at least partially and includes at least the most external surface of the object.

A display case includes an upper portion and a lower portion. When the upper portion and the lower portion are connected, items can be stored and displayed within the display case. The upper portion has a rim defining an opening, a substantially cylindrical portion extending from the rim, and a curvilinear portion extending from the substantially cylindrical portion and terminating in a substantially flat portion. The upper portion is substantially transparent. The lower portion includes a first surface having a first receiving portion formed therein, a sealing surface extending from the first surface and configured to be inserted into of the opening and engage with the substantially cylindrical portion, and a second surface opposite the first surface which forms a second receiving portion. The first receiving portion and the second receiving portion are substantially the same size and configured to receive a base of a toy. The base of the toy can be friction fit into the first receiving portion and the second receiving portion interchangeably.

The display case can be used in at least two configurations. In a first configuration, the base of the toy is received in the first receiving portion and the upper portion is frictionally engaged with the sealing surface of the lower portion. Accordingly, the toy is enclosed and displayed within the display case in the first configuration. In the second configuration, the upper portion is oriented so that the flat portion is configured to contact a plane, for example furniture, and the second surface faces upward from the plane. The base of the toy can be received in the second receiving portion on top of the display case, and other items, such as other toys, office supplies, or jewelry, can be contained and displayed in the upper portion.

An example of a display case 1 is shown in FIG. 1. The display case 1 includes an upper portion 100 and a lower portion 200. The upper portion 100 includes a rim 102 which defines an opening 104. The rim 102 is substantially circular. A substantially cylindrical portion 106 extends from the rim 102. A curvilinear portion 108 extends from the substantially cylindrical portion 105 and terminates in a substantially flat portion 110. The rim 102, the substantially cylindrical portion 106, the curvilinear portion 108, and the substantially flat portion 110 can seamlessly form the upper portion 100. In other examples, the upper portion 100 can be formed by multiple separate pieces that are connected to one another by methods such as adhesion. The upper portion 100 can be shaped similar to a dome with a substantially flat top. While the disclosure focuses on a rim 102 that is substantially circular, the rim 102 can be other suitable shapes, for example, substantially rectangular or ovoid, such that the other features of the display case 1 are adjusted accordingly.

The upper portion 100 is substantially transparent. In at least one example, the upper portion 100 can be clear or tinted one or more different colors, such as yellow or green, but maintains a level of transparency so that items within the display case 1 are still visible. The upper portion 100 can be made of polycarbonate where the upper portion 100 is substantially shatter-proof and is not toxic. In other examples, the upper portion 100 can be made of any suitable material or polymer that is safe for children and is substantially transparent, for example a combination of polycarbonate and acrylonitrile butadiene styrene, poly(methyl methacrylate), or glass.

Figure 2:
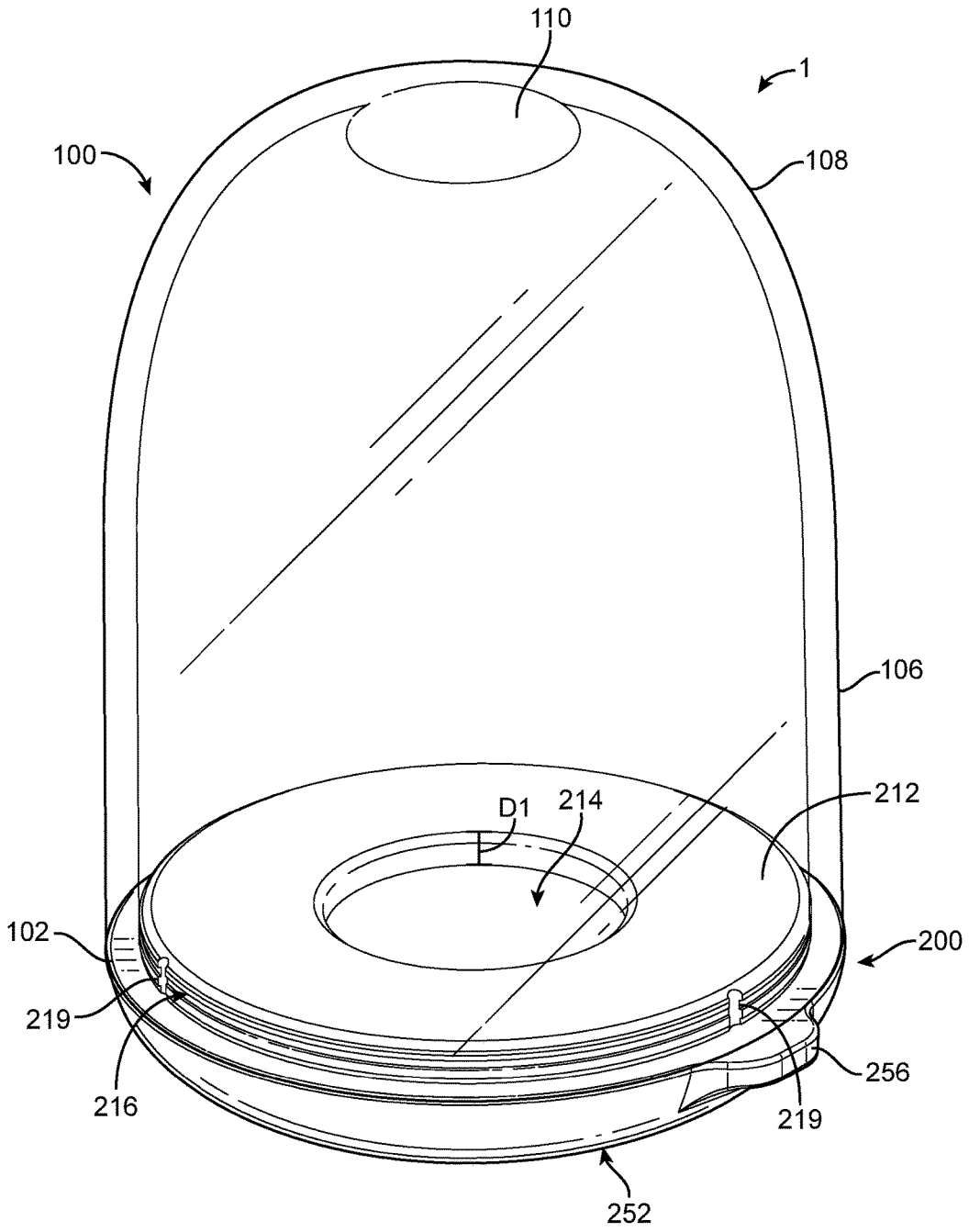
FIG. 2 is a top perspective, assembled view of the display case of FIG. 1.
Figure 3:
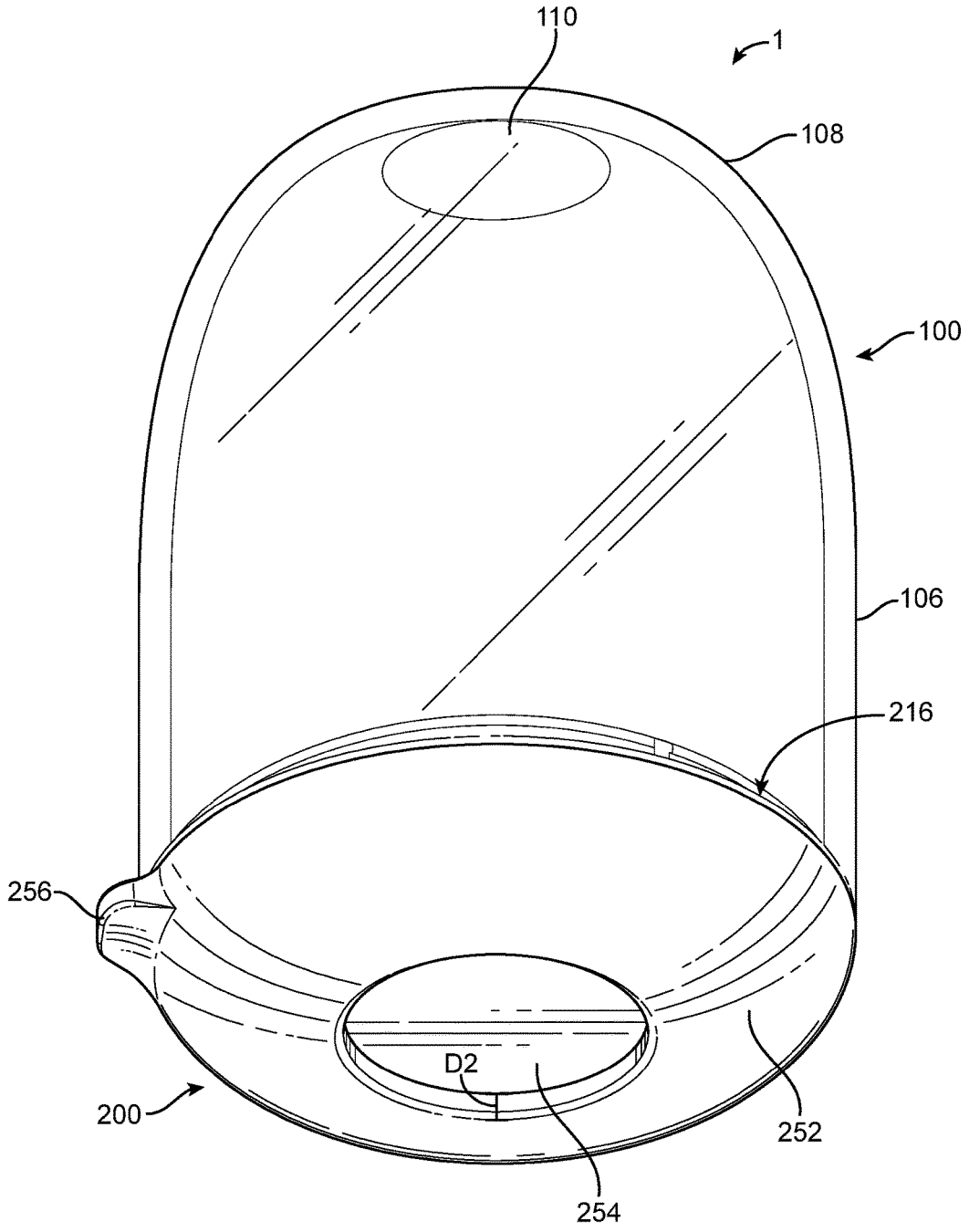
FIG. 3 is a bottom perspective view of FIG. 2.
Figure 4:
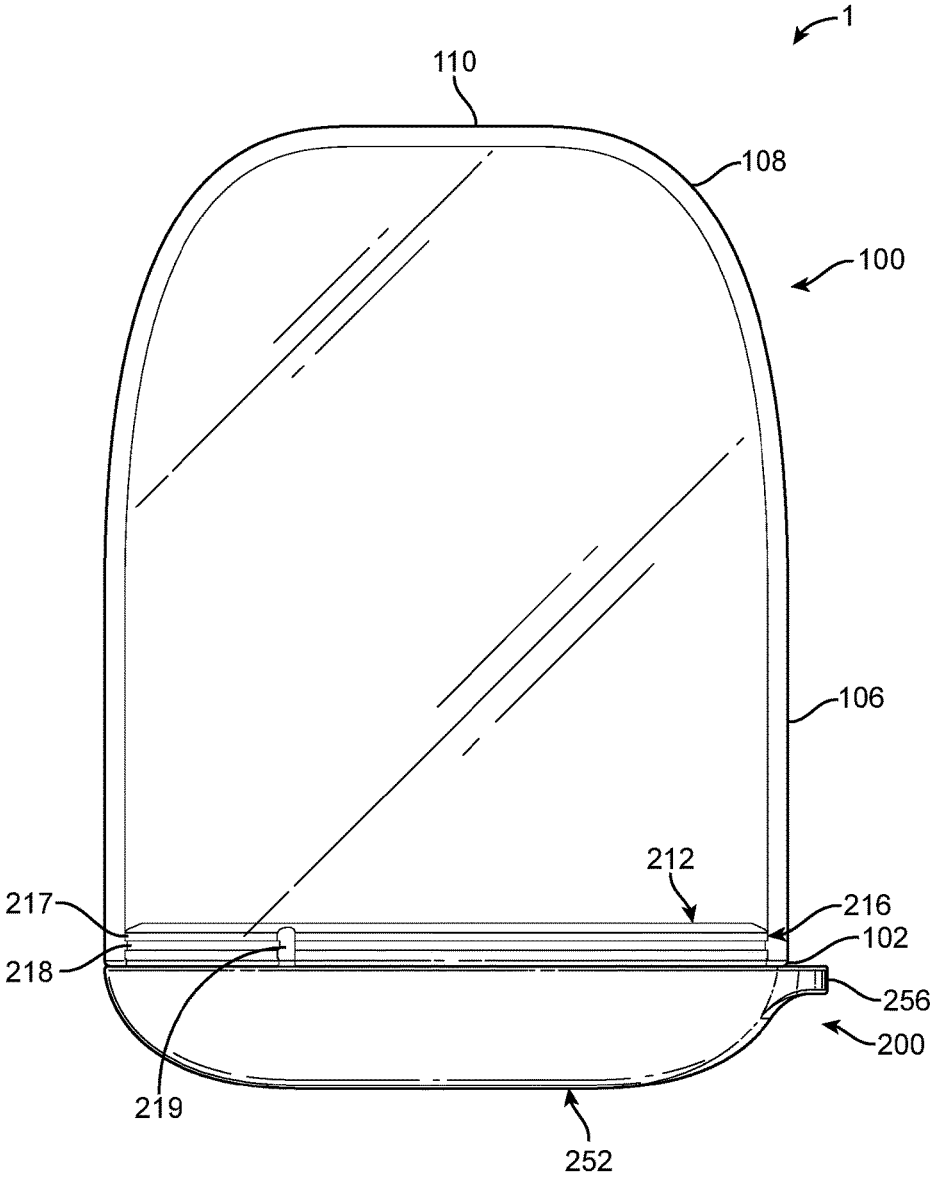
FIG. 4 is a left side elevational view of FIG. 2.
Figure 5:
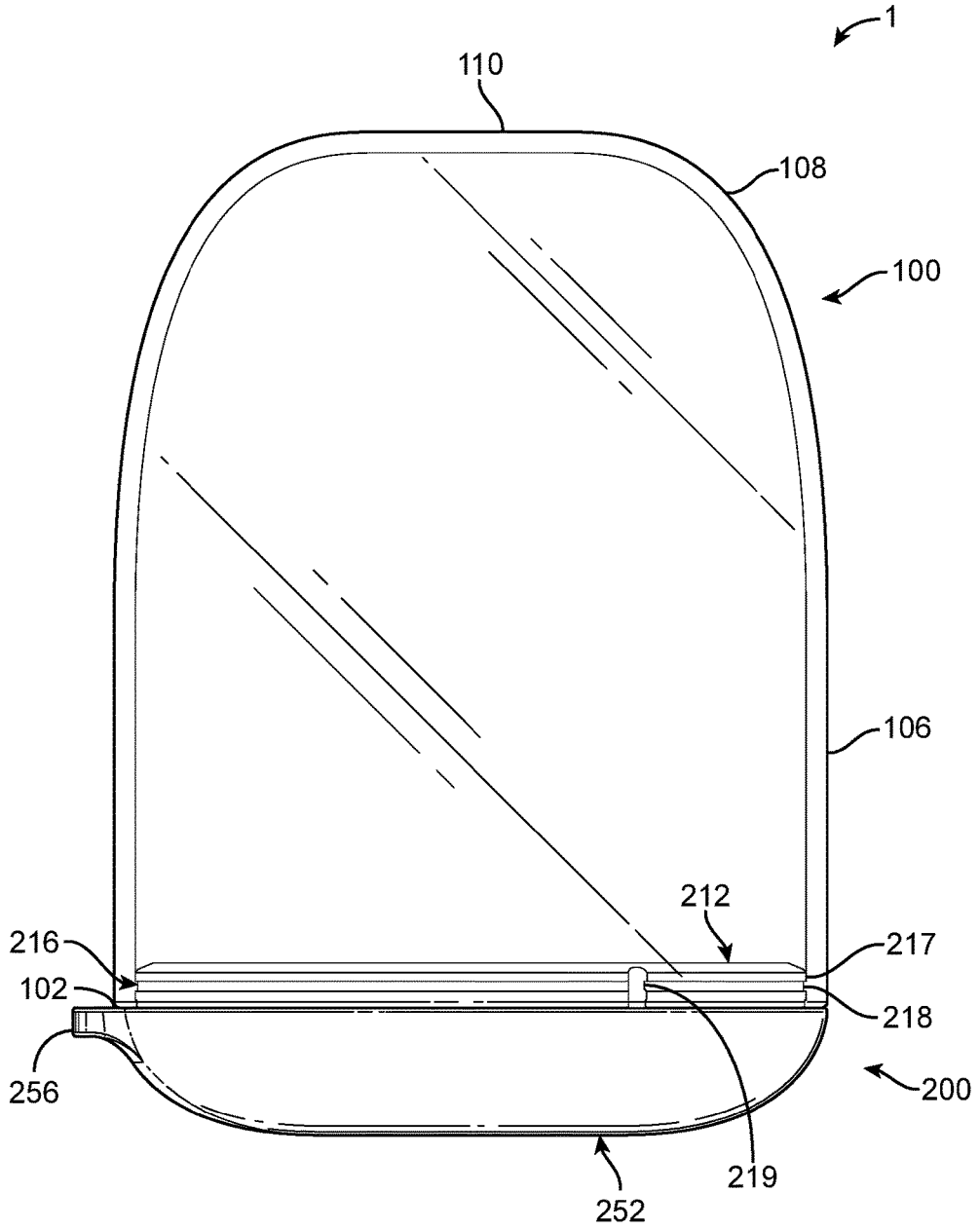
FIG. 5 is a right side elevational view of FIG. 2.
Figure 6:
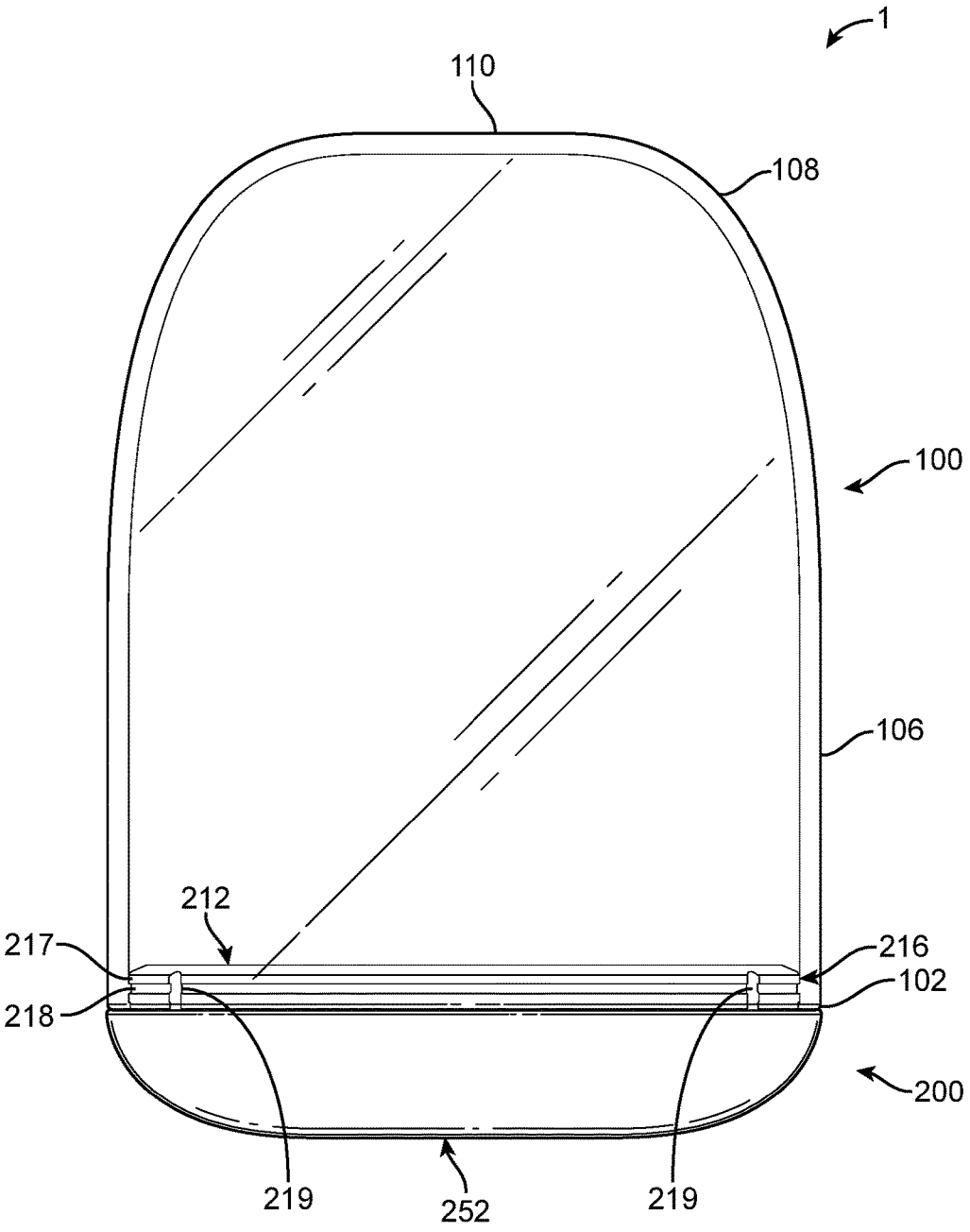
FIG. 6 is a front elevational view of FIG. 2.
Figure 7:
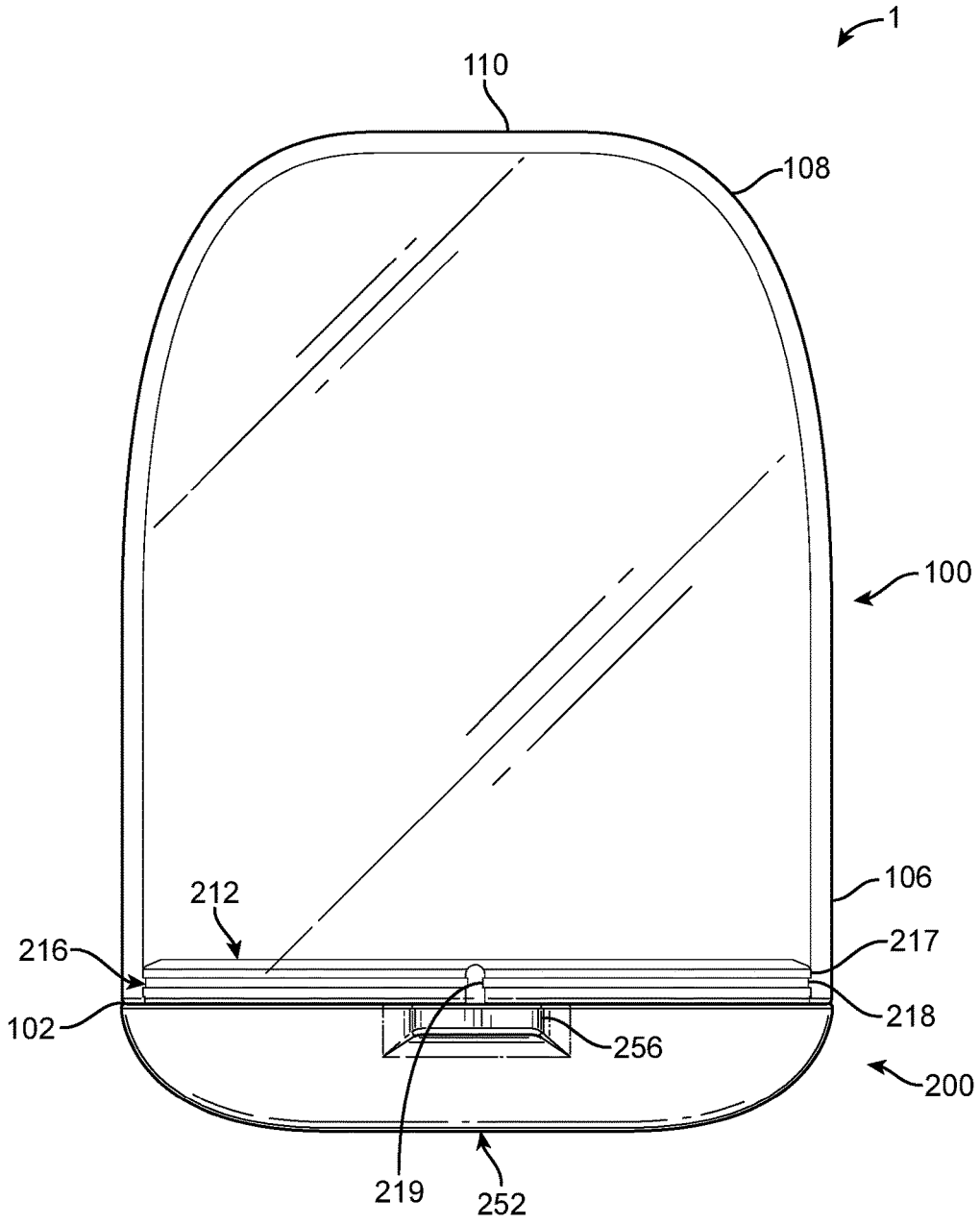
FIG. 7 is a rear elevational view of FIG. 2.
Figure 8:
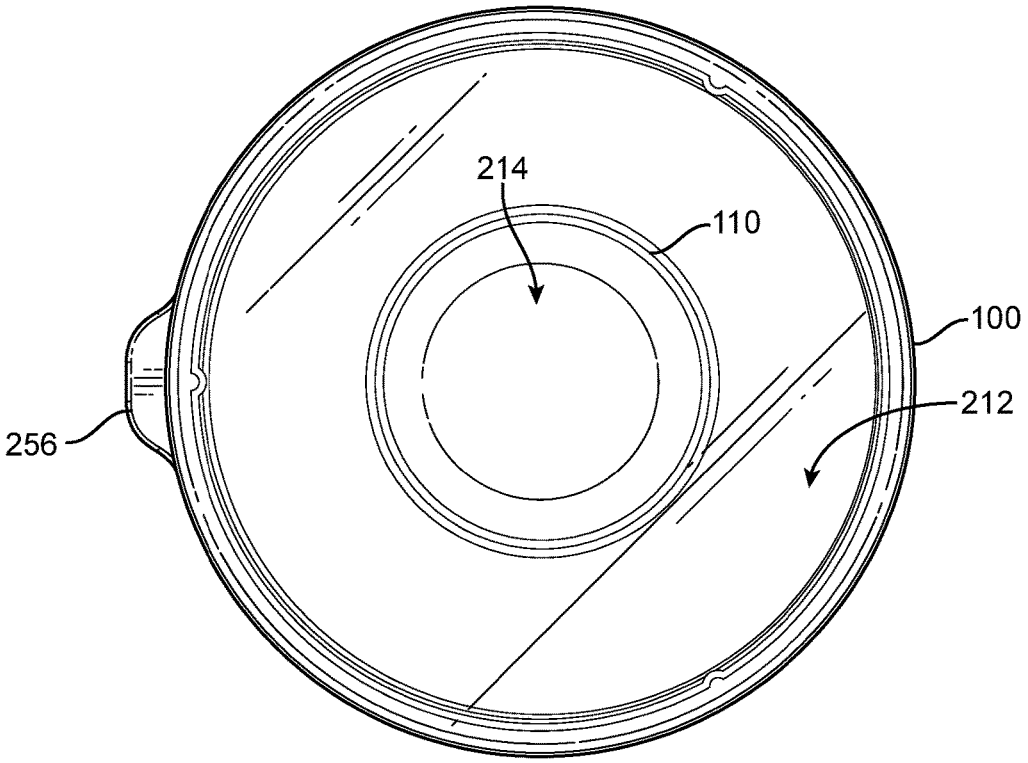
FIG. 8 is a top plan view of FIG. 2.
Figure 9:
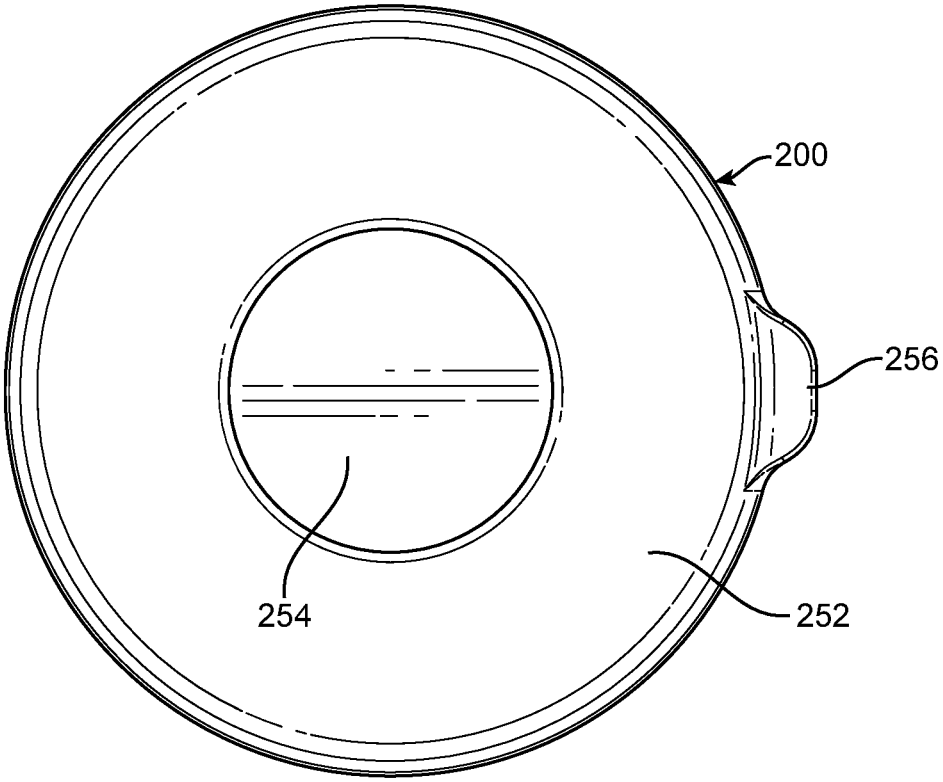
FIG. 9 is a bottom plan view of FIG. 2.

The upper portion 100 is configured to be coupled with the lower portion 200, as shown in FIGS. 2-9. FIGS. 2 and 3 show top and bottom perspective views of the assembled display case 1. FIGS. 4-7 show left, right, front, and rear elevational views of the assembled display case 1. FIGS. 8-9 show top and bottom plan views of the display case 1.

The lower portion 200 includes a first surface 212 which has a first receiving portion 214 formed therein. The first receiving portion 214 is configured to be coupled with a base of a toy. The first receiving portion 214 can be a recess that is formed in the first surface 212. In other examples, the first receiving portion 214 can be a magnetic element that is configured to couple with a magnetic element of a toy. In yet other examples, the first receiving portion 214 can be a protrusion that is configured to be received in a base of a toy. The first receiving portion 214, as illustrated, is substantially circular but can be any other suitable shape such as rectangular, ovoid, or triangular. The first receiving portion 214 is shaped and has a depth D1 to receive a base of an item such as a toy by friction fit. In other examples, the first surface 212 can have more than one first receiving portions 214 formed therein.

The lower portion 200 has a sealing surface 216 which extends from the first surface 212. The sealing surface 216 is configured to be inserted into of the opening 104 and engage with the substantially cylindrical portion 106. As can be seen in FIGS. 1 and 4-7, the sealing surface 210 can include a plurality of ridges 217. The sealing surface 216 can have three or more ridges 217. In other examples, the sealing surface 216 can have one or two ridges 217. In other examples, the ridges 217 can be a screw thread. The ridges 217 can radially extend from the first surface 212. The ridges 217 are spaced apart from one another, and each of the ridges 217 are substantially circumferential. The plurality of ridges 217 have at least one groove 218 formed therein. In other examples, the sealing surface 216 does not include grooves 218. The ridges 217 can have sufficient flexibility such that when the ridges 217 of the sealing surface 216 engage with the inside of the substantially cylindrical portion 106, the ridges 217 bend and form a seal when engaged with the upper portion 100. The sealing surface 217 can also include one or more notches 219 that span substantially perpendicularly across the ridges 217 and grooves 218. The notches 219 can provide an opening in the sealing surface 216 and prevent a vacuum seal from being formed by the sealing surface 216 and the upper portion 100. As such, a seal is formed, but the upper portion 100 and the lower portion 200 can be separated without substantial effort.

As shown in FIGS. 1-5 and 7-9, the lower portion 200 includes a tab 256 which extends in a radial direction. The tab 256 assists in separation of the upper portion 100 and the lower portion 200. The tab 256 can be an extension of the lower portion 200, or in other examples, the tab 256 can be a separate piece that is coupled to the lower portion 200. The tab 256 can be any suitable shape, for example substantially rectangular, triangular, or ovoid, such that a force can be enacted downward on the tab 256 in a direction that is opposite the upper portion 100. An opposing force is enacted on the upper portion 100 such that the engagement between the sealing surface 216 and the substantially cylindrical portion 106 is overcome, and the upper portion 100 and the lower portion 200 are separated.

As shown in FIGS. 3 and 9, the lower portion 200 also includes a second surface 252 opposite the first surface 212 which has a second receiving portion 254 formed therein. The second receiving portion 254 is substantially the same size, shape, and depth D2 as the first receiving portion 214. Similarly, the second receiving portion 254 is configured to receive a base of an item such as a toy by friction fit.

Figure 10:
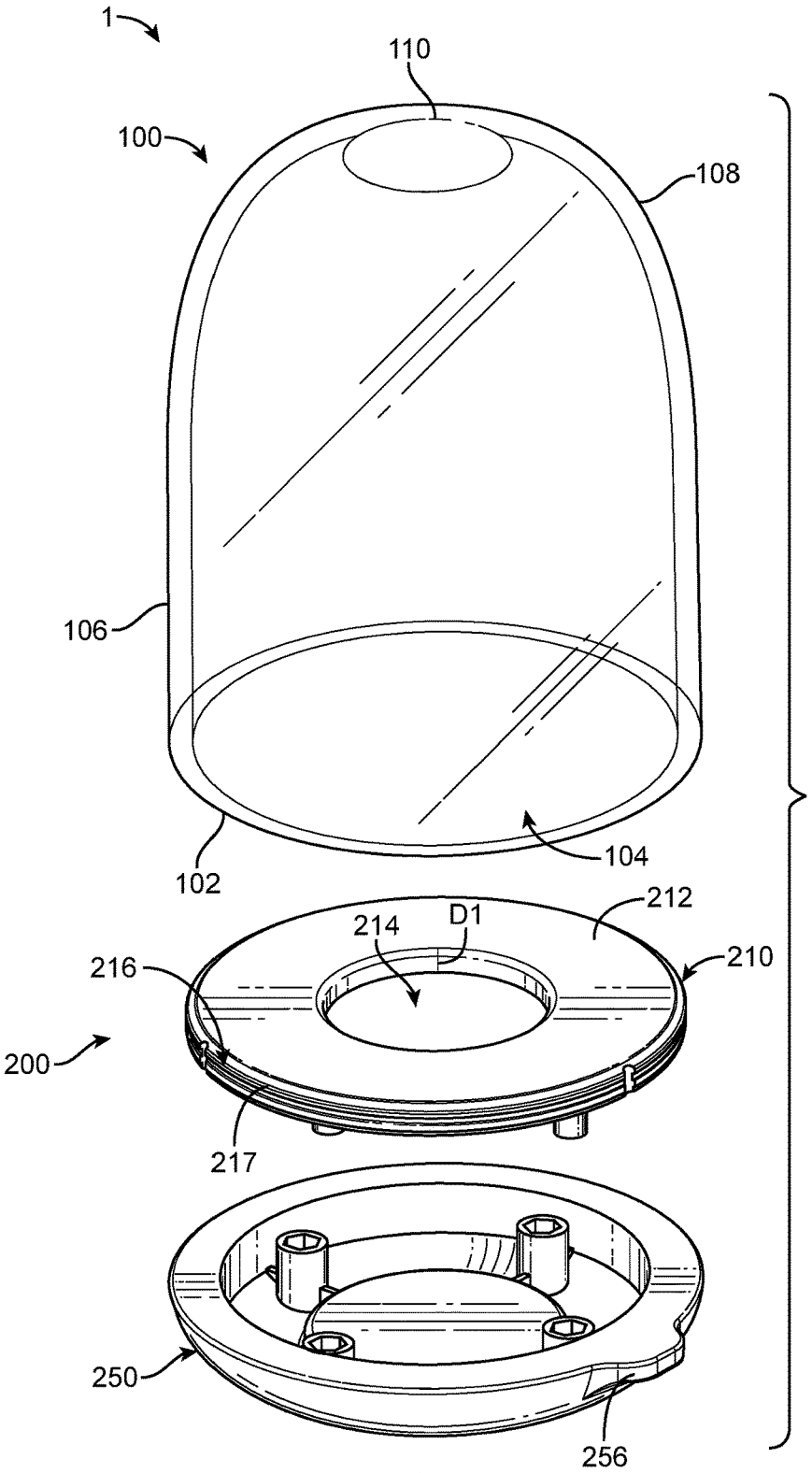
FIG. 10 is an exploded view of a display case.

The lower portion 200 can include a top portion 210 and a bottom portion 250 as shown in FIG. 10. While the disclosure focuses on the lower portion 200 including a top portion 210 and a bottom portion 250, in other examples, the lower portion 200 can be one piece. The top portion 210 includes the first surface 212 and the first receiving portion 214; the bottom portion 250 includes the second surface 252 and the second receiving portion 254. In the illustrated examples, the top portion 210 includes the sealing surface 216, and the bottom portion 250 includes the tab 256 extending radially therefrom.

Figure 11:
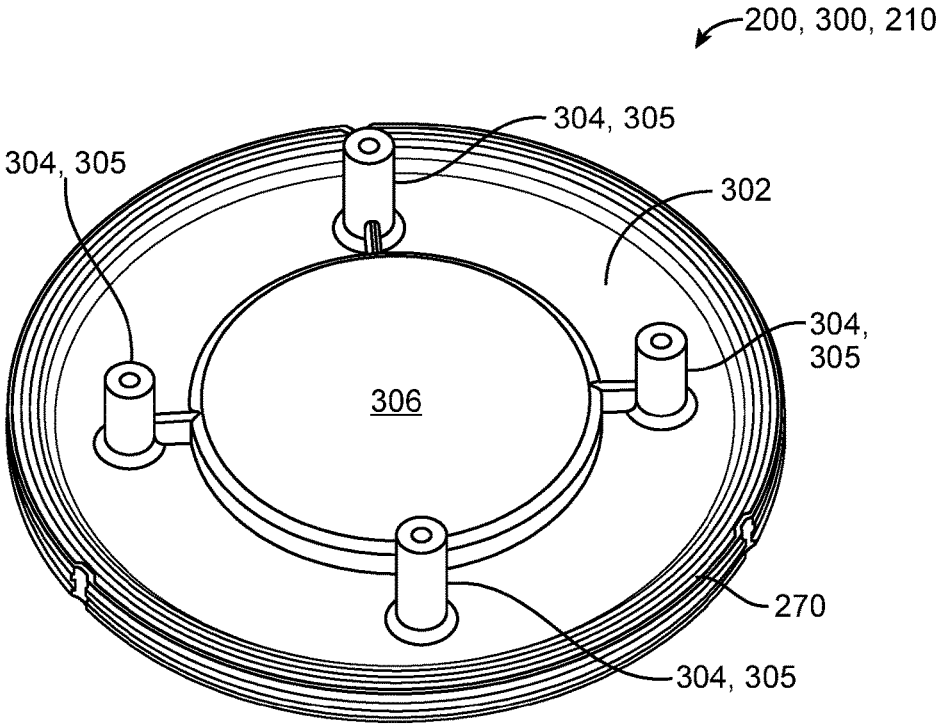
FIG. 11 is a perspective view of the underside of a top portion of a lower portion of FIG. 10.
Figure 12:
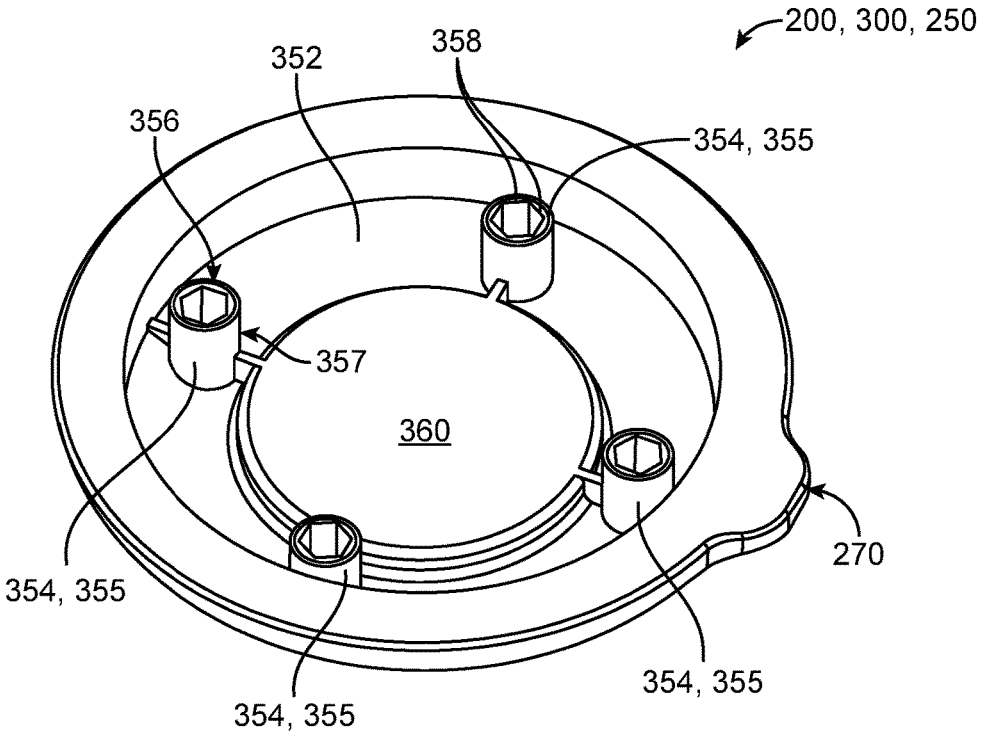
FIG. 12 is a perspective view of a bottom portion of a lower portion of FIG. 10.

The top portion 210 and the bottom portion 250 form an internal structure 300 within the lower portion 200, as shown in FIGS. 11 and 12. The top portion 210 has a bottom surface 302 which is opposite to the first surface 212, as shown in FIG. 11. A top connecting portion 304 extends from the bottom surface 302. In other examples, the top connecting portion 304 can include at least one recess that are configured to receive a protrusion to couple the top portion 210 and the bottom portion 250. The top connecting portion 304 can include a plurality of pegs 305 which can be substantially cylindrical. In other examples, the pegs 305 can be cuboidal. The top portion 210 has a protruding portion 306, which corresponds to the first receiving portion 214, and the top portion 210 is thinner than the depth D1 of the first receiving portion 214. In other examples, the top portion 210 can be the same or be thicker than the depth D1 of the first receiving portion 214.

The bottom portion 250, as shown in FIG. 12, includes a top surface 352 opposite to the second surface 252. The bottom portion 250 has a protruding portion 360 which corresponds to the second receiving portion 254. The depth D2 of the second receiving portion 254 is thinner than the bottom portion 250. A bottom connecting portion 354 extends from the top surface 352 and is configured to matingly engage with the top connecting portion 302 of the top portion 210. In other examples, the bottom connecting portion 354 can include at least one recess that is configured to receive a protrusion to connect the top portion 210 and the bottom portion 250. The bottom connecting portion 354 includes a plurality of receptacles 355 configured to accept the insertion of a corresponding one of the plurality of pegs 305 of the top connecting portion 304. In other examples, the bottom connecting portion 354 can include protrusions configured to be received by recesses formed in the top connecting portion 304. The plurality of receptacles 355 have a generally cylindrical shape both on an inside 356 and on an outside 357. In other examples, the plurality of receptacles 355 and the pegs 305 can be cuboidal, as long as the pegs 305 can be inserted into the receptacles 355 to connect the top portion 210 and the bottom portion 250.

The plurality of receptacles 355 can include a plurality of flat pads 358 formed on the inside 356 of the receptacles 355. The plurality of flat pads 358 are configured to provide a friction fit when the pegs 305 are inserted. Each receptacle 355 can include six flat pads 358 to create a hexagonal shape on the inside 356 of the receptacles 355. In other examples, the receptacles 355 can include one or more flat pads 358. The flat pads 358 are flexible and compressible such that, when the pegs 305 are inserted, the flat pads 358 are compressed and create a friction fit. In at least one example, an adhesive can be included to adhere the flat pads 358 to the inside 356 of the receptacles 355. Further, an adhesive can be used to further fasten the pegs 305 within the receptacles 355.

Other methods can be used to connect the top portion 210 and the bottom portion 250. In one example, the thicknesses of the top portion 210 and the bottom portion 250 are different such that the protruding portions 306, 360 of the top portion 210 and the bottom portion 250 can contact one another. The pegs 305 and the receptacles 355 may be excluded. The protruding portions 306, 360 can be coupled together by adhesive. In other examples, the top portion 210 and the bottom portion 250 can be coupled by snap fit. In yet other examples, the top portion 210 and the bottom portion 250 can be coupled by ultrasonic welding.

The lower portion 200, including the top portion 210 and the bottom portion 250 can be made of a polymer, for example acrylonitrile butadiene styrene (ABS). In at least one example, the first surface 212, the second surface 252, and the tab 256 can have an elastic material 270 coupled thereto. The elastic material can be co-molded on the first surface 212, the second surface 252, and the tab 256. In other examples, the elastic material 270 can be coupled to or co-molded on one or any combination of the first surface 212, the second surface 252, and the tab 256. In yet other examples, the elastic material 270 can be coupled to or co-molded on only portions of the first surface 212, the second surface 252, and the tab 256. For example, the elastic material 270 can be coupled to or co-molded on only the first receiving portion 214 and/or the second receiving portion 254. In at least one example, the elastic material 270 can be silicon which can further be coated with texture paint. In other examples, the elastic material 270 can include thermoplastic urethane, thermoplastic urethane and cross-linked silicone rubber, or soft polyvinyl chloride. The elastic material 270 assists in providing a conformance fit with a base 20 of a toy 2, as shown in FIGS. 13 and 14.

Figure 13:
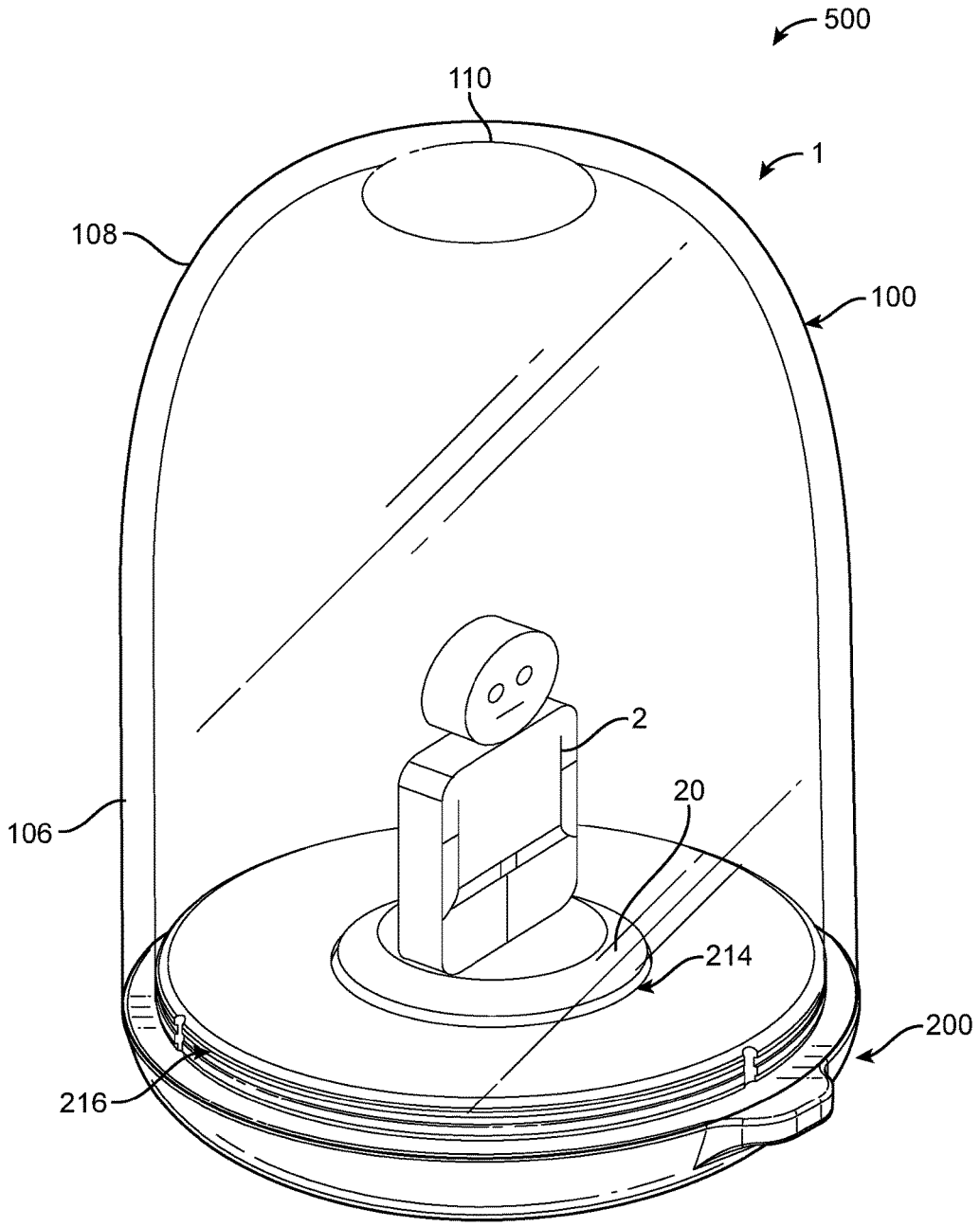
FIG. 13 is a perspective view of a display case with a toy in a first configuration.

FIG. 13 shows the display case 1 in a first configuration 500. In the first configuration 50, a toy 2 is placed within the display case 1. The base 20 of the toy 2 is received within the first receiving portion 214. The base 20 is configured to correspond to the first receiving portion 214 such that the base can be received by the first receiving portion 214. The base 20 of the toy 2 can be secured by friction fit. The base 20 can be made of ABS or any other suitable material. In other examples, the base 20 can include polycarbonate, a combination of polycarbonate and acrylonitrile butadiene styrene, poly(methyl methacrylate), high impact polystyrene, glass, wood, metal, or alloy.

The upper portion 100 is connected to the lower portion 200 such that the toy 2 is enclosed within the display case 1. The toy 2 and the sealing surface 216 are inserted inside the opening 104 of the upper portion 100, and the sealing surface 216 is frictionally engaged with the substantially cylindrical portion 106 of the upper portion 100.

Figure 14:
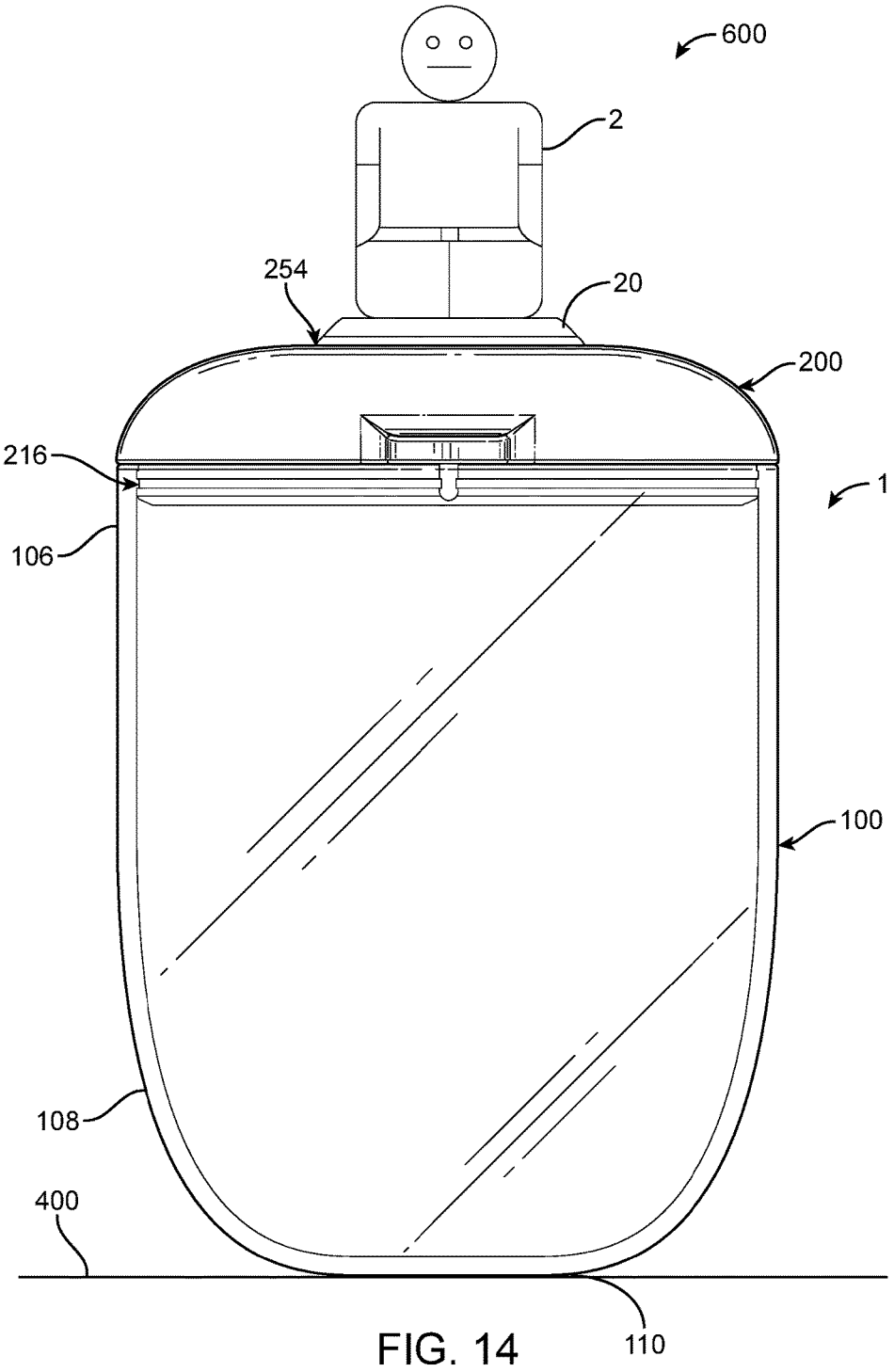
FIG. 14 is a rear elevational view of a display case with a toy in a second configuration.

The display case 1 can also be utilized in another configuration 600, as shown in FIG. 14. In configuration 600, the base 20 of the toy 2 is received in the second receiving portion 254. The toy 2 and the associated base 20 can be friction fit into the first receiving portion 214 and the second receiving portion 254 interchangeably. The upper portion 100 is oriented so that the flat portion 110 is configured to contact a plane 400 as the second surface 252 faces upward from the plane 400. The plane 400 can be any surface in which the display case 1 can be supported and balanced by the flat portion 110. In at least one example, the plane 400 can be furniture, such as a table, or the ground. While the toy 2 is on top of the display case 1, as in configuration 600, items, such as other toys, office supplies, or jewelry can be contained and displayed within the upper portion 100.

The embodiments shown and described above are only examples. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including, the full extent established by the broad general meaning of the terms used in the claims.

The invention claimed is:

1. A display case comprising:

an upper portion comprising:

a rim defining an opening;

a substantially cylindrical portion extending from the rim; and a curvilinear portion extending from the substantially cylindrical portion and terminating in a substantially flat portion; and a lower portion comprising:

a first surface having a first receiving portion formed therein;

a sealing surface extending from the first surface and configured to be inserted into of the opening and engage with the substantially cylindrical portion; and a second surface opposite the first surface and forming a second receiving portion, wherein the first receiving portion and the second receiving portion are substantially a same size and configured to receive a base of a toy.

2. The display case as recited in claim 1, wherein the sealing surface includes a plurality of ridges spaced apart from one another and each of the plurality of ridges being substantially circumferential.

3. The display case as recited in claim 2, wherein the plurality of ridges have at least one groove formed therein.

4. The display case as recited in claim 3, wherein the plurality of ridges numbers three or more.

5. The display case as recited in claim 1, wherein the lower portion further comprises an internal structure comprising:

a top portion having the first surface, a bottom surface opposite to the first surface, and a top connecting portion extending from the bottom surface; and a bottom portion having the second surface, a top surface opposite to the second surface, and a bottom connecting portion extending from the top surface and configured to matingly engage with the top connecting portion.

6. The display case as recited in claim 5, wherein the top connecting portion comprises a plurality of pegs and the bottom connecting portion comprises a plurality of receptacles configured to accept insertion of a corresponding one of the plurality of pegs.

7. The display case as recited in claim 6, wherein the plurality of receptacles have a generally cylindrical shape both on an inside and an outside.

8. The display case as recited in claim 7, wherein the plurality of receptacles include a plurality of flat pads formed on the inside, wherein the plurality of flat pads are configured to provide a friction fit when the corresponding one of the plurality of pegs are inserted.

9. The display case as recited in claim 5, wherein the bottom portion has a tab that extends in a radial direction.

10. The display case as recited in claim 9, wherein the first surface, the second surface and the tab have an elastic material coupled thereto, whereby the elastic material is to provide a conformance fit with the base of the toy.

11. The display case as recited in claim 5, wherein the top portion is thinner than a depth of the first receiving portion, whereby the top portion has a protruding portion corresponding to the first receiving portion.

12. The display case as recited in claim 5, wherein a depth of the second receiving portion is thinner than the bottom portion, whereby the bottom portion has a protruding portion corresponding to the second receiving portion.

13. The display case as recited in claim 1, wherein the first surface has an elastic material coupled thereto.

14. The display case as recited in claim 1, wherein the first surface has an elastic material co-molded on the first surface.

15. The display case as recited in claim 1, wherein the second surface has an elastic material coupled thereto.

16. The display case as recited in claim 1, wherein the second surface has an elastic material co-molded on the second surface.

17. A display case comprising:

an upper portion comprising:

a rim defining an opening;

a substantially cylindrical portion extending from the rim;

a curvilinear portion extending from the substantially cylindrical portion and terminating in a substantially flat portion;

a lower portion comprising:

a first surface having a first receiving portion formed therein;

a sealing surface extending from the first surface and configured to be inserted into of the opening and engage with the substantially cylindrical portion;

a second surface opposite the first surface and forming a second receiving portion, a toy having a base configured to be friction fit into the first receiving portion and the second receiving portion interchangeably.

18. The display case as recited in claim 17, wherein in a first configuration the base of the toy is received in the first receiving portion and the upper portion is frictionally engaged with the sealing surface of the lower portion.

19. The display case as recited in claim 18, wherein in a second configuration the base of the toy is received in the second receiving portion and the upper portion is oriented so that the flat portion is configured to contact a plane and the second surface faces upward from the plane.

* * * * *